US007819099B2

(12) United States Patent
Lawrence et al.

(10) Patent No.: US 7,819,099 B2
(45) Date of Patent: Oct. 26, 2010

(54) ROTARY HYDRAULIC COUPLING

(75) Inventors: Nicholas James Lawrence, Buckingham (GB); Ian Methley, Witney (GB); Timothy Mark Lancefield, Shipston on Stour (GB)

(73) Assignee: Mechadyne PLC, Kirtlington (GB)

( * ) Notice: Subject to any disclaimer, the term of this patent is extended or adjusted under 35 U.S.C. 154(b) by 405 days.

(21) Appl. No.: 12/062,667

(22) Filed: Apr. 4, 2008

(65) Prior Publication Data

US 2008/0184950 A1 Aug. 7, 2008

(51) Int. Cl.
*F01L 1/34* (2006.01)

(52) U.S. Cl. ..... 123/90.17; 123/90.15; 123/90.12; 464/160

(58) Field of Classification Search ..... 123/90.12, 123/90.13, 90.15, 90.17, 90.16, 90.18; 464/1, 464/2, 160

See application file for complete search history.

(56) References Cited

U.S. PATENT DOCUMENTS 4,928,997 A 5/1990 Reisener et al.
6,247,436 B1 6/2001 Lancefield et al.
6,725,817 B2 4/2004 Methley et al.
7,228,831 B1 * 6/2007 O'Gorman et al. ..... 123/90.17
2003/0015157 A1 1/2003 Knecht et al.

FOREIGN PATENT DOCUMENTS

GB 2401150 3/2004

* cited by examiner

*Primary Examiner*—Ching Chang
(74) *Attorney, Agent, or Firm*—Chernoff, Vilhauer, McClung & Stenzel

(57) ABSTRACT

A rotary hydraulic coupling is described for use in an engine having a camshaft, a hydraulic phaser for driving the camshaft, and an oil feed manifold secured to the body of the engine and incorporating oil galleries for supplying oil to the phaser. The rotary coupling, which serves to connect the oil galleries of the oil feed manifold to rotating oil ducts which lead to hydraulic working chambers within the phaser, comprises a cylindrical first element rotatably received within and sealed relative to an annular second element, each of the first and second elements having bores that communicate with annular grooves in a mating surface of at least one of the two elements to establish fluid flow communication between the bores in the two elements, the bores in the first element being connected to axially extending oil passages formed within the first element. In the invention, the first element is formed of an outer tube and an inner spool, and the axially extending oil passages in the first element are formed by channels and/or holes in the inner spool.

10 Claims, 7 Drawing Sheets

Fig. 6a
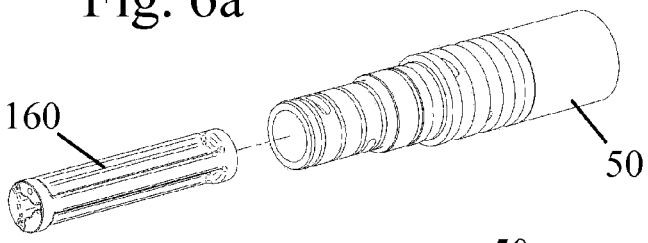
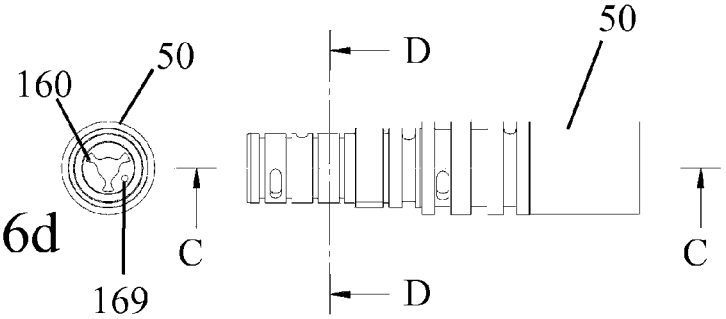
Fig. 6d
Fig. 6b
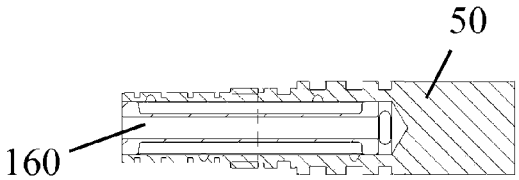
Fig. 6c
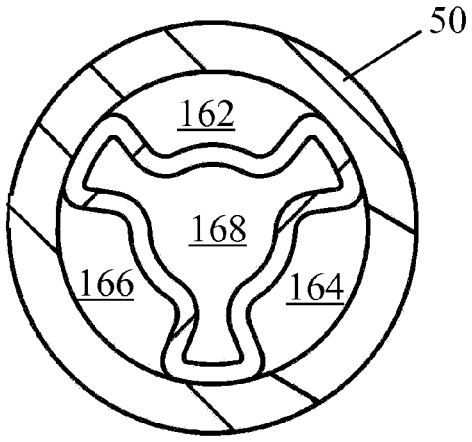
Fig. 7

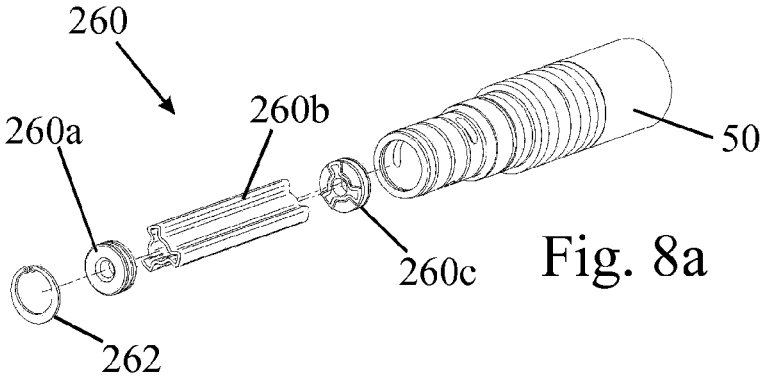
Fig. 8a
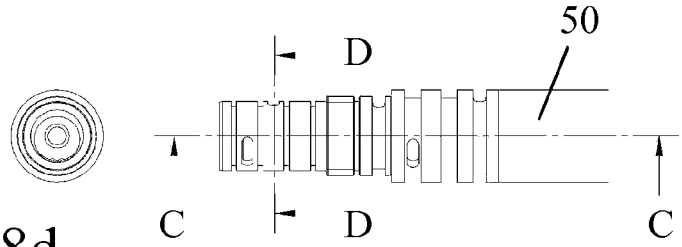
Fig. 8b
Fig. 8d
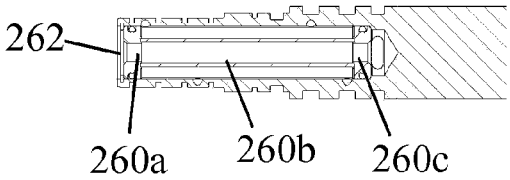
Fig. 8c
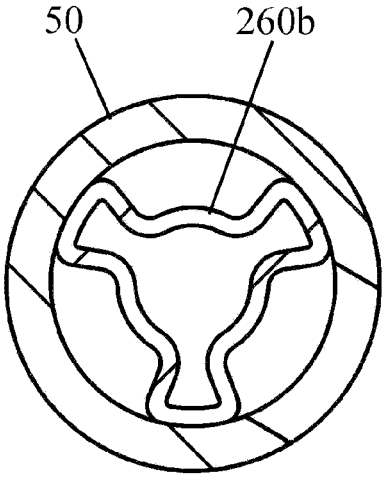
Fig. 9
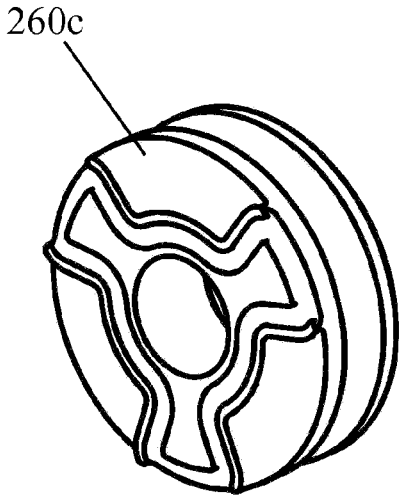
Fig. 10

Fig. 14a
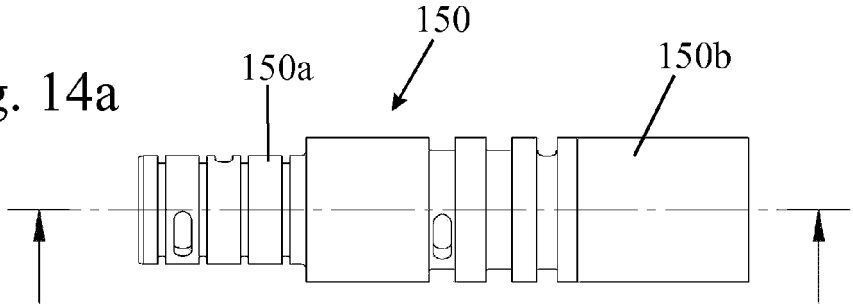
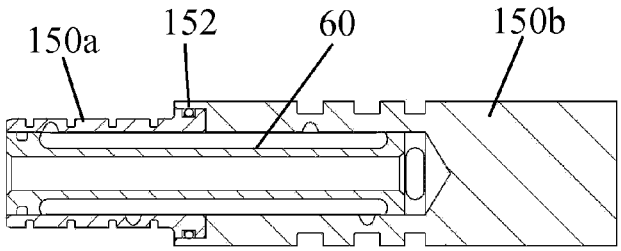
Fig. 14b

ROTARY HYDRAULIC COUPLING

FIELD OF THE INVENTION

The present invention relates to a rotary coupling for feeding oil to a hydraulic phaser driving an engine camshaft.

BACKGROUND OF THE INVENTION

Phasers that use hydraulic oil pressure to control the phase of the cams on engine camshafts are known, an example being described in U.S. Pat. No. 6,725,817. The phaser in the latter patent specification, in common with those to be described herein, is a twin-vane phaser having two output members, the phase of each of which is adjustable relative to a stator driven by the engine crankshaft. The invention is not however restricted to twin-vane phasers and is also applicable to single vane phasers in which the phase of only one output member is adjustable relative to the engine crankshaft.

In order to supply hydraulic oil under pressure to the working chambers of such a hydraulic phaser, it is known, for example from U.S. Pat. No. 6,247,436, that an engine mounted front cover or oil feed manifold can convey oil from an oil pump via a control valve to the phaser.

As all hydraulic camshaft phasers require two or more oil lines (supply and return), one needs to provide a rotary hydraulic coupling to establish a connection between the lines in the cover/manifold and the phaser.

A known oil feed arrangement is described in EP 1473443 where the camshaft has an axially projecting extension that is rotatably and sealingly received in an opening formed in the front cover/manifold to enable the oil passage in the camshaft to communicate with the oil galleries in the engine cover. Such an extension is hereinafter referred to as a "cam nose".

Although the invention could be equally applicable to a spigot style of oil feed, as described in U.S. Pat. No. 6,725,817, it will be described herein with reference to an oil feed arrangement with a cam nose similar to that of EP 1473443.

FIG. 1 of the accompanying drawings shows a sectional view through a camshaft phaser 10 fitted over a protruding cam nose 12 of an assembled SCP (single cam phaser) camshaft 14 having cams 16 and 18 that can be rotated relative to one another. Some cams, such as the cam 16, are fixed to and rotate with an outer tube 20 of the SCP camshaft 14 while other cams, such as the cams 18, rotate with the inner shaft 22 of the SCP camshaft 14 to which they are coupled by means of a pin 24 passing through a circumferentially elongated slot in the outer tube 20. A bearing 26 fixed to the outer tube 20 is connected by one or more pins 28 to be driven by the rear end plate 30 of the phaser 10, while the inner shaft 22 is driven by a front end plate 32 of the phaser 10 to which it is coupled by a nut 34.

The phaser 10 is a known twin-vane cam phaser (see for example U.S. Pat. No. 6,725,817) of which the internal construction is not shown in FIG. 1. A stator 38 solid with an engine driven sprocket 36 is formed with arcuate recesses that receive vanes secured to the end plates 30 and 32. The vanes divide each recess into different working chambers and by controlling the oil supply to and from the different working chambers, the end plates 30 and 32 of the phaser, acting as output members, can be rotated relative to the stator 38.

The known cam noses, as depicted in FIG. 1, are simple turned parts with axial drillings 40 that form part of the phaser oil feeds or returns. The cam nose 12 of FIG. 1 is shown in more detail in the perspective, side, end and sectional views of FIGS. 2*a* to 2*d* has four such axial drillings, one pair of supply and return passages for controlling each of the two output members.

Packaging limitations dictate that the outer diameter of the cam nose 12 (within which the axial drillings 40 must be packaged) must be small. This makes it costly and difficult to machine the axial drillings in the cam nose, resulting in a design that is unattractive for volume production. Furthermore, it is hard to utilise the potential flow area within the cam nose as the drillings cannot be packaged together very closely. A further shortcoming is that the central portion, generated in-between the drillings 40, is of no use as it offers minimal structural benefit.

SUMMARY OF THE INVENTION

With a view to mitigating the foregoing disadvantages, the present invention provides a rotary hydraulic coupling for use in an engine having a camshaft, a hydraulic phaser for driving the camshaft having hydraulic working chambers and rotating oil ducts leading to the hydraulic working chambers, and an oil feed manifold secured to the body of the engine and incorporating oil galleries for supplying oil to and from the phaser, the rotary coupling serving to connect the oil galleries of the oil feed manifold to the rotating oil ducts leading to hydraulic working chambers of the phaser and comprising a cylindrical first element having axially extending oil passages; an annular second element surrounding and sealed relative to the first element, annular grooves in a mating surface of at least one of the two elements, and bores in each of the first and second elements that communicate with the annular grooves to establish fluid flow communication between the bores in the two elements, the bores in the first element being connected to the axially extending oil passages in the first element, wherein the first element is formed of an outer tube and an inner spool assembly of at least one part, and the axially extending oil passages in the first element are formed by at least one of the group comprising channels and holes in the inner spool.

The invention is based on making a cam nose that rotates with the camshaft, or a stationary spigot that projects into the phaser, in two or more initially separate parts namely an inner spool assembly and an outer tube, at least some of the oil passages leading to the working chambers of the phaser being defined by the interface between inner spool and the outer tube. Because the passages can now be formed by machining or otherwise forming channels or recesses in the outer surface of the inner spool before it is assembled into the outer tube, one has greater freedom in the design and the positioning of the oil passages allowing the flow resistance of the passages to be optimised. The other benefit of this approach is increased ease of manufacture and therefore a reduced piece cost.

BRIEF DESCRIPTION OF THE DRAWINGS

The invention will now be described further, by way of example, with reference to the accompanying drawings, in which:—

FIGS. 6*a* to 6*d* are similar views to FIGS. 3*a* to 3*d* of a rotary coupling comprising the outer tube of FIG. 2 and a second design of inner spool, FIG. 7 shows a transverse section through the cam nose of FIGS. 6*a* to 6*d,*

FIGS. 8*a* to 8*d* are similar views to FIGS. 3*a* to 3*d* of a rotary coupling comprising the outer tube of FIG. 2 and a third design of inner spool formed of three separate components, FIG. 9 is a section through the middle component of the spool in FIGS. 8*a* to 8*d,*

FIG. 10 is a perspective view of one of the end components of the inner spool of FIGS. 8*a* to 8*d,*

FIGS. 14*a* and 14*b* are a side view and a section, respectively, of the cam nose shown in FIG. 13.

DETAILED DESCRIPTION OF THE PREFERRED EMBODIMENTS

The modified cam nose shown in FIGS. 3*a* to 3*d* is designed as a hollow tube 50 with a single large central bore 52 for receiving an inner spool as shown in all the other figures to be described below. The outer surface of the tube 50 is formed with annular grooves 54 that are intersected by slotted radial bores 56. Oil can flow from the interior of the tube 50 through the bores 56 into the annular grooves 54, which in turn communicate with associated oil passages in the phaser in all relative angular positions of the phaser and the tube 50.

The inner spool that is inserted into the outer tube 50 to provide axially extending oil passages leading to the bores 56 can take on a variety of forms which are described below and illustrated in various ones of the remaining figures of the drawings.

Figure 1:
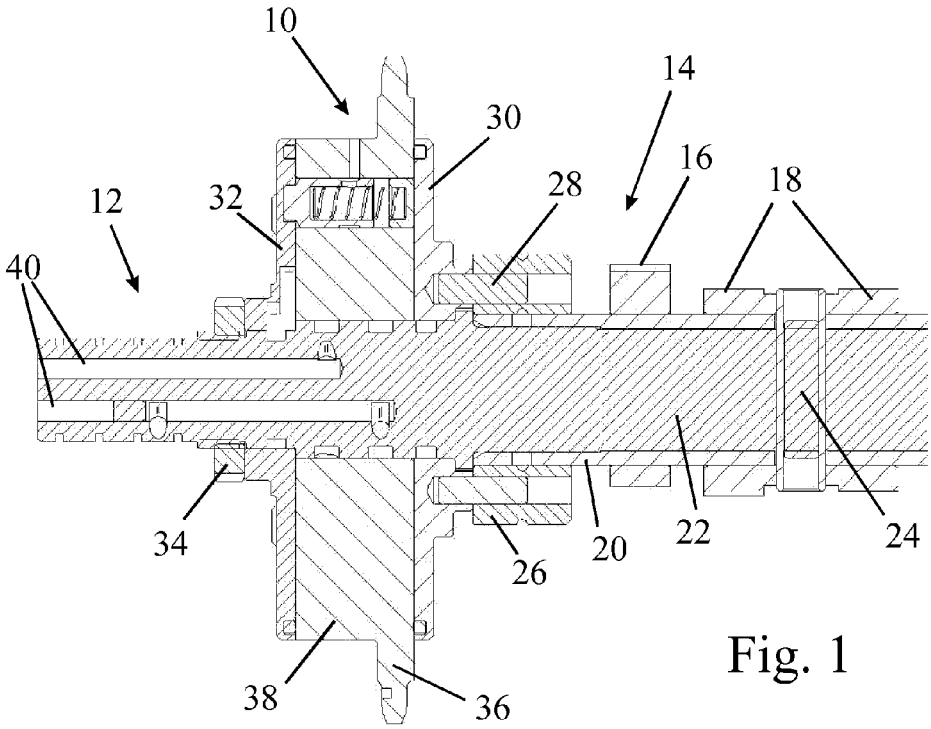
FIG. 1 is, as described above, a section through a known phaser fitted over the cam nose of an SCP camshaft.
Figure 2A:
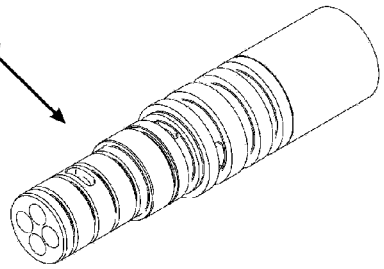
FIGS. 2*a* to 2*d* show perspective, side, end and sectional views, respectively, of the cam nose in FIG. 1, FIGS. 3*a* to 3*d* are similar views of the outer tube of a rotary hydraulic coupling of the invention, formed as a cam nose.
Figure 2D:
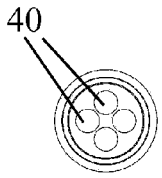
Figure 2B:
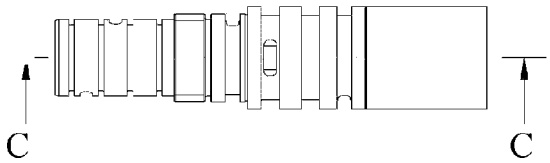
Figure 2C:
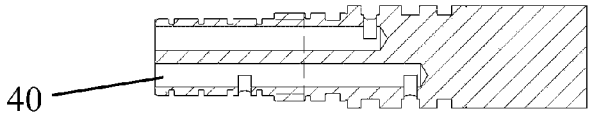
Figures 3A, 3B, 3C, 3D:
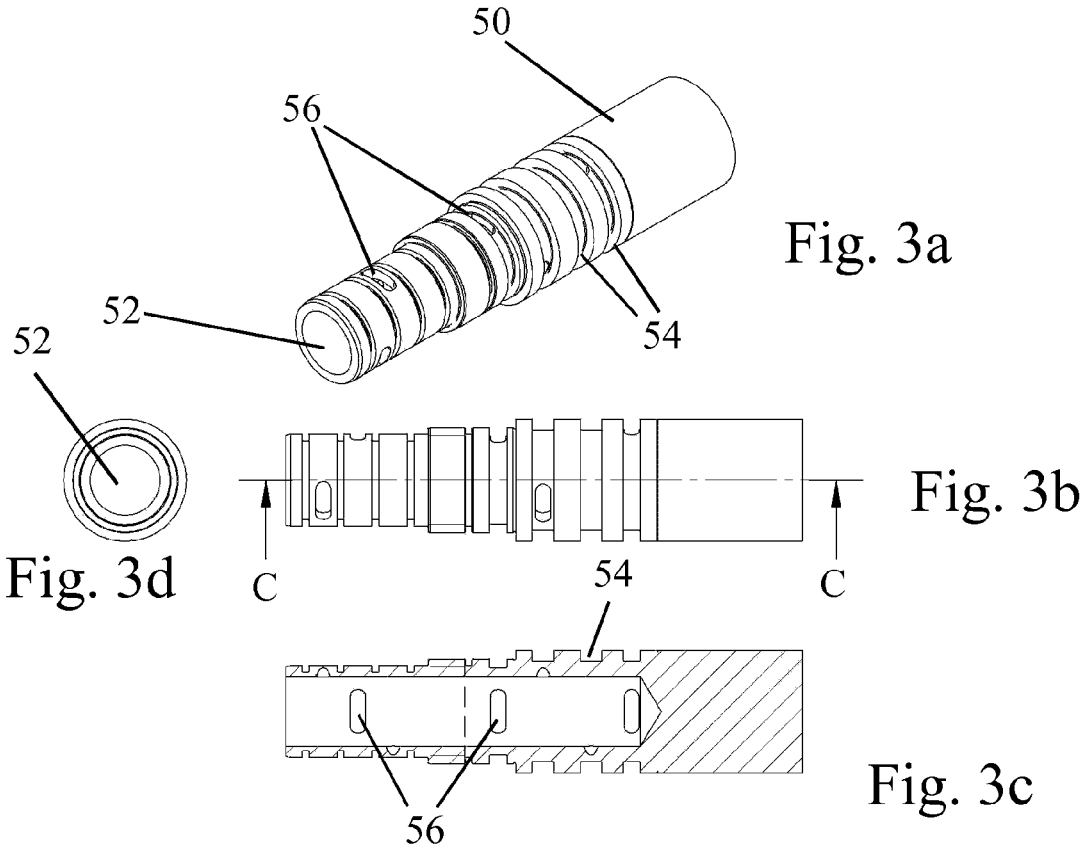
Figure 4A:
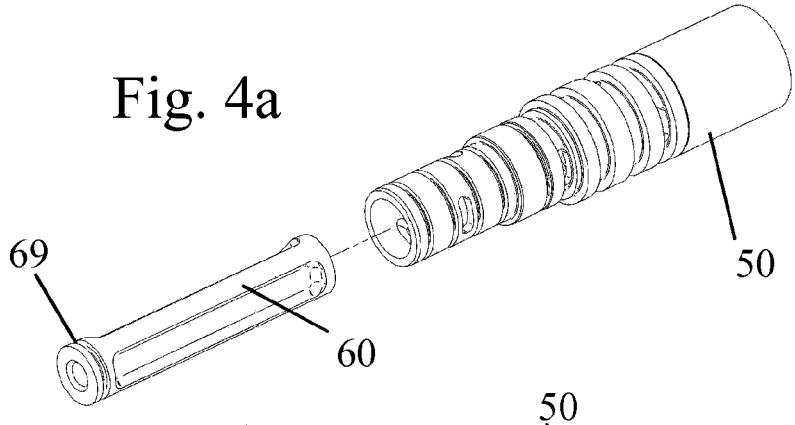
FIGS. 4*a* to 4*d* are similar views to FIGS. 3*a* to 3*d* of a rotary coupling comprising the outer tube of FIGS. 3*a* to 3*d* and a first design of inner spool.
Figure 4B:
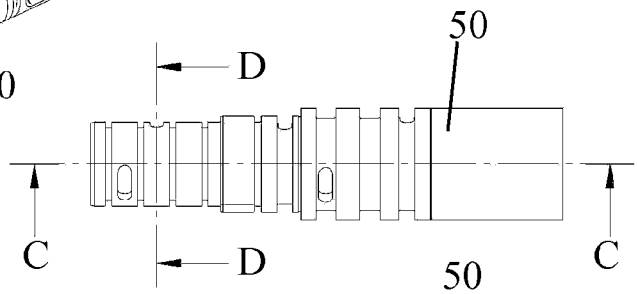
Figure 4D:
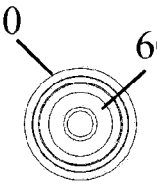
Figure 4C:
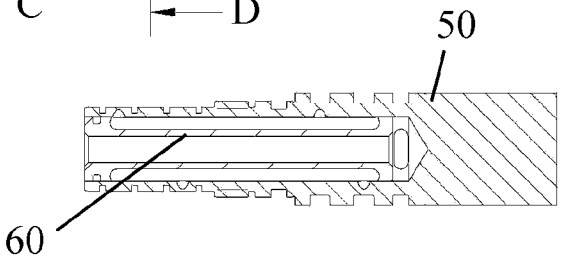
Figure 5:
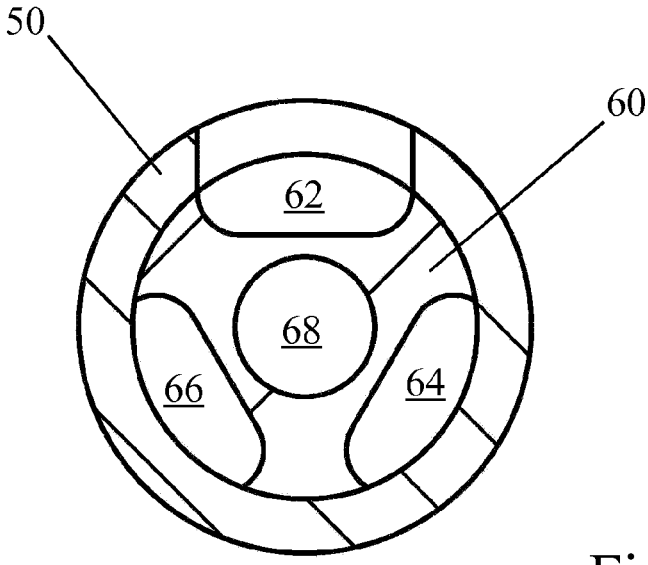
FIG. 5 shows a transverse section through the inner spool in FIGS. 4*a* to 4*d* when fitted within the outer tube.

In the embodiment of the invention in FIGS. 4 and 5, the inner spool 60 is a simple machined part. The spool 60, when inserted into the outer tube 50, defines four axially extending passages (see FIG. 5) of which three are formed by channels 62, 64 and 66 machined in the outer surface of the spool 60 and the fourth by a central bore 68.

It is not essential to have a central bore and it would be alternatively possible for all the passages to be formed by channels similar to the channels 62 to 66.

The inner spool 60 insert can be an interference fit in the outer tube 50 to help with sealing. Alternatively, the inner spool 60 may be fitted with one or more seals to achieve the same effect. A sealing groove 69 is shown at the front of the spool 60 and such a groove may typically be used in conjunction with an O-ring seal.

FIGS. 6*a* to 6*d* show similar perspective, side, section and end views of a second embodiment of the invention, while FIG. 7 shows the cross section of the inner spool to an enlarged scale.

The inner spool 160 in this case is a moulded part which may be made from a metallic or a plastics material. The cross section is intended to encourage compliance by allowing radial deformation of the spool 160 when it is placed in the outer tube 50. The inner spool 160 can then be made with a higher interference to the drilling in the cam nose outer tube 50, allowing the assembly to be less sensitive to manufacturing tolerances. This will also encourage better sealing between the separate oil feeds 162, 164, 166 and 168. The front of the inner spool 160 has a feature, namely a simple hole 169, to help align it with the outer tube 50 during assembly.

FIGS. 8*a* to 8*d* show an exploded view of an embodiment having of a similar inner spool to that of FIGS. 6 and 7. However, in this embodiment, in order to simplify manufacture, the inner spool 260 is split axially into three separate components 260*a*, 260*b* and 260*c*.

The middle component 260*b* of the spool has a similar cross section to that of the inner spool shown in FIG. 7. This component 260*b* could be formed as an extrusion or by deformation of a tube. The end components 260*a* and 260*c* have features on them to seal the four feeds, but they may alternatively be formed as flat rubber sealing disks. FIG. 8*a* also shows a circlip 262 used to retain the components of the inner spool 260 in the outer tube 50.

Figure 11:
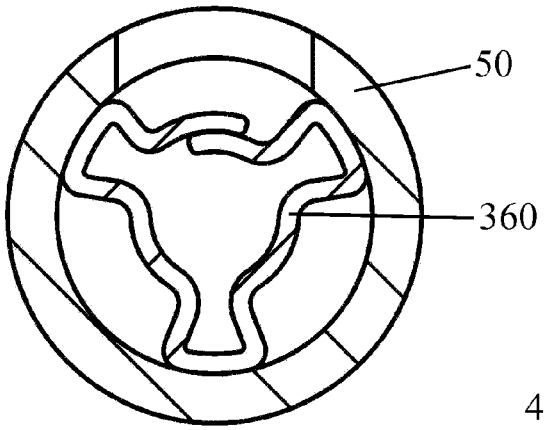
FIGS. 11 and 12 are sections similar to the section of FIG. 9 showing alternative designs of the inner spool.
Figure 12:
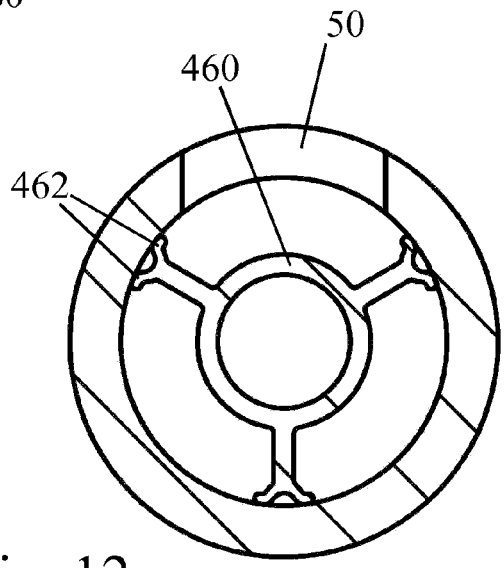

FIGS. 11 and 12 show further embodiments in which the cross section of the inner spool can be arranged or fabricated to achieve the same effect.

The inner spool 360 of FIG. 11 is formed from a flat sheet of which the two ends are overlapped and sealed together, such as by welding.

The inner spool 460 of FIG. 12 has deformable sealing lips 462 where it contacts with the inner surface of the outer tube 50 of the cam nose.

Figure 13:
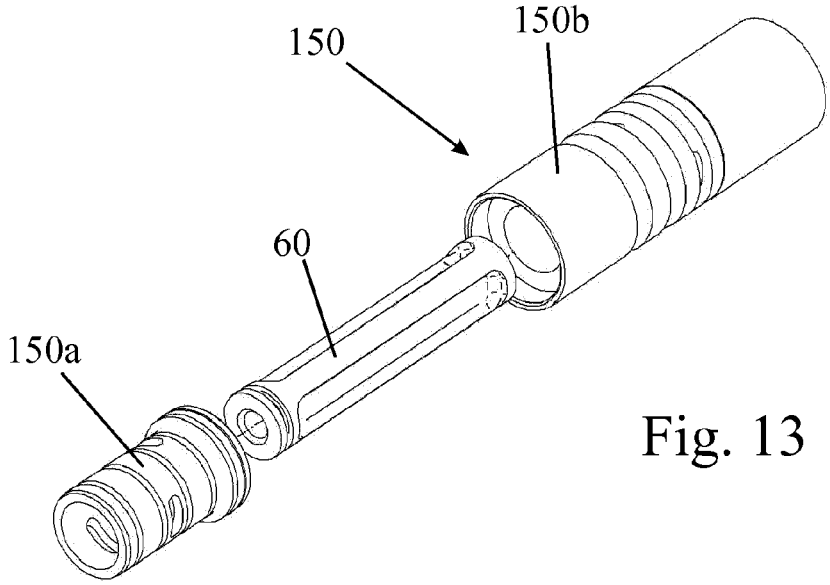
FIG. 13 is an exploded perspective view of a cam nose and inner spool of a further embodiment of the invention.

FIGS. 13, 14*a* and 14*b* show an exploded perspective view, a side view and a section, respectively, of the cam nose outer tube 150 and the inner spool of a further embodiment of the invention.

This embodiment of the invention differs from the previously described embodiments in that the front portion 150*a* of the cam nose outer tube 150 that interfaces with the oil feeds in the engine front cover is also a separate part, as best seen in FIG. 13. The inner spool 60, which is the same as the shown in FIG. 4*a*, fits into both portions 150*a* and 150*b* of the cam nose outer tube 150. The front portion 150*a* contains the sealing rings and features for the interface with the engine cover while the rear portion 150*b* is attached to the camshaft. There is some form of seal 152 in-between the two portions 150*a* and 150*b* to prevent oil leakage from the feeds.

While the invention has been described with reference to a cam nose that rotates with the camshaft, it will be appreciated that the invention is equally applicable to the design of a stationary spigot secured to the engine front cover and received in an annular element that rotates with the camshaft.

The invention claimed is:

1. A rotary hydraulic coupling for use in an engine having a camshaft, a hydraulic phaser for driving the camshaft having hydraulic working chambers and rotating oil ducts leading to the hydraulic working chambers, and an oil feed manifold secured to the body of the engine and incorporating oil galleries for supplying oil to and from the phaser, the rotary coupling serving to connect the oil galleries of the oil feed manifold to the rotating oil ducts leading to hydraulic working chambers of the phaser and comprising a cylindrical first element having axially extending oil passages; an annular second element surrounding and sealed relative to the cylindrical first element, annular grooves in a mating surface of at least one of the cylindrical first element and the annular second element, and bores in each of the cylindrical first and the annular second elements that communicate with the annular grooves to establish fluid flow communication between the bores in the cylindrical first element and the annular second element, the bores in the cylindrical first element being connected to the axially extending oil passages in the first element, wherein the cylindrical first element is formed of an outer tube and an inner spool assembly of at least one part, and the axially extending oil passages in the cylindrical first element are formed by at least one of the group comprising channels and holes in the inner spool.

2. The rotary coupling of claim 1, wherein the inner spool is an interference fit in the outer tube in order to isolate the passages defined by the channels in the outer surface of the inner spool from one another.

3. The rotary coupling of claim 1, comprising flexible seals to isolate oil feed passages from one another.

4. The rotary coupling of claim 1, wherein the inner spool comprises a single axially extending hole, the remaining axially extending passages being formed by channels in the outer surface of the inner spool.

5. The rotary coupling of claim 1, wherein a feature is provided on the inner spool to ensure correct alignment with the outer tube of the cylindrical first element.

6. The rotary coupling of claim 1, wherein the cross section of the inner spool is such as to enable the inner spool to be radially compliant.

7. The rotary coupling of claim 6, wherein the inner spool is formed by deforming a tube or rolling a flat sheet.

8. The rotary coupling of claim 1, wherein the inner spool comprises a plurality of separable components.

9. The rotary coupling of claim 8, wherein the components of the inner spool are retained in assembled relationship by means of a circlip.

10. The rotary coupling of claim 1, wherein the outer tube of the cylindrical first element is formed from at least two axially separable portions, both in sealing engagement with the inner spool.

* * * * *